US006070602A

United States Patent [19]

Ling Kuo

[11] Patent Number: 6,070,602

[45] Date of Patent: Jun. 6, 2000

[54] OPENING STRUCTURE OF A MULTIPLE FOLDED UMBRELLA

[76] Inventor: Cheng Miao Ling Kuo, No. 18, Alley 15, Lane 582, Sea Ta Road, Hsinchu, Taiwan

[21] Appl. No.: 09/085,584

[22] Filed: May 27, 1998

[51] Int. Cl.[7] ..... A45B 19/08

[52] U.S. Cl. ..... 135/25.4; 135/19; 135/22; 135/40; 135/41; 135/24

[58] Field of Search ..... 135/24, 25.4, 25.41, 135/19, 22, 20.3, 25.1, 28, 29, 31, 32, 37, 39, 40, 41

[56] References Cited

U.S. PATENT DOCUMENTS

| | | | |
|---|---|---|---|
| 5,020,558 | 6/1991 | Huang | 135/24 |
| 5,144,969 | 9/1992 | Chou et al. | 135/22 |
| 5,161,562 | 11/1992 | Wu | 135/20.3 |
| 5,267,583 | 12/1993 | Wu | 135/24 |
| 5,361,792 | 11/1994 | Lin et al. | 135/24 |
| 5,483,985 | 1/1996 | Yu | 135/22 |
| 5,533,541 | 7/1996 | Cheng et al. | 135/22 |
| 5,564,449 | 10/1996 | Lin et al. | 135/24 |
| 5,720,311 | 2/1998 | Lin et al. | 135/25.1 |

*Primary Examiner*—Carl D. Friedman
*Assistant Examiner*—Yvonne M. Horton
*Attorney, Agent, or Firm*—Rosenberg, Klein & Lee

[57] ABSTRACT

An opening structure of a multiple folded umbrella is provided that includes a shaft formed by several tubes, a runner provided around the shaft, an upper connector provided on an upper tube of the shaft, and a frame having many ribs pivotally connected with the upper connector and the runner. The upper tube of the shaft is provided with an inwardly directed flange at a position intermediate opposing ends of the upper tube, and a plate is provided on the flange. A connecting cap is slidingly received in the top end of the upper tube and receives a spring within the cap and within the upper tube, concealing the spring within the upper tube. The upper connector is cylindrical and slides on the upper tube and has a small volume, to thereby be carried and stored more easily and conveniently.

2 Claims, 4 Drawing Sheets

OPENING STRUCTURE OF A MULTIPLE FOLDED UMBRELLA

BACKGROUND OF THE INVENTION

A prior art multiple folded umbrella, as shown in FIG. 1, includes an upper connector (1) provided with an inner hole to receive a spring (11) around a main shaft of the umbrella. A connecting cap (12) is provided at an upper position. By use of the elastic force of the spring (11), the umbrella is capable of being opened automatically. In this known structure, the spring (12) is directly exposed and easily rusted. Moreover, the known upper connector (11) has a large volume that makes the umbrella have a large volume in a closed state and is inconvenient to carry.

OBJECT OF THE INVENTION

The main object of the present invention is to provide an improved opening structure of a multiple folded umbrella, which includes a special upper connector and improved springs for overcoming the drawbacks of prior art umbrellas.

The detailed structure, features, and other advantages of this invention will become apparent from the following detailed description of a preferred embodiment when read with reference to the accompanying drawings.

DETAILED DESCRIPTION OF THE PREFERRED EMBODIMENT

Figure 1:
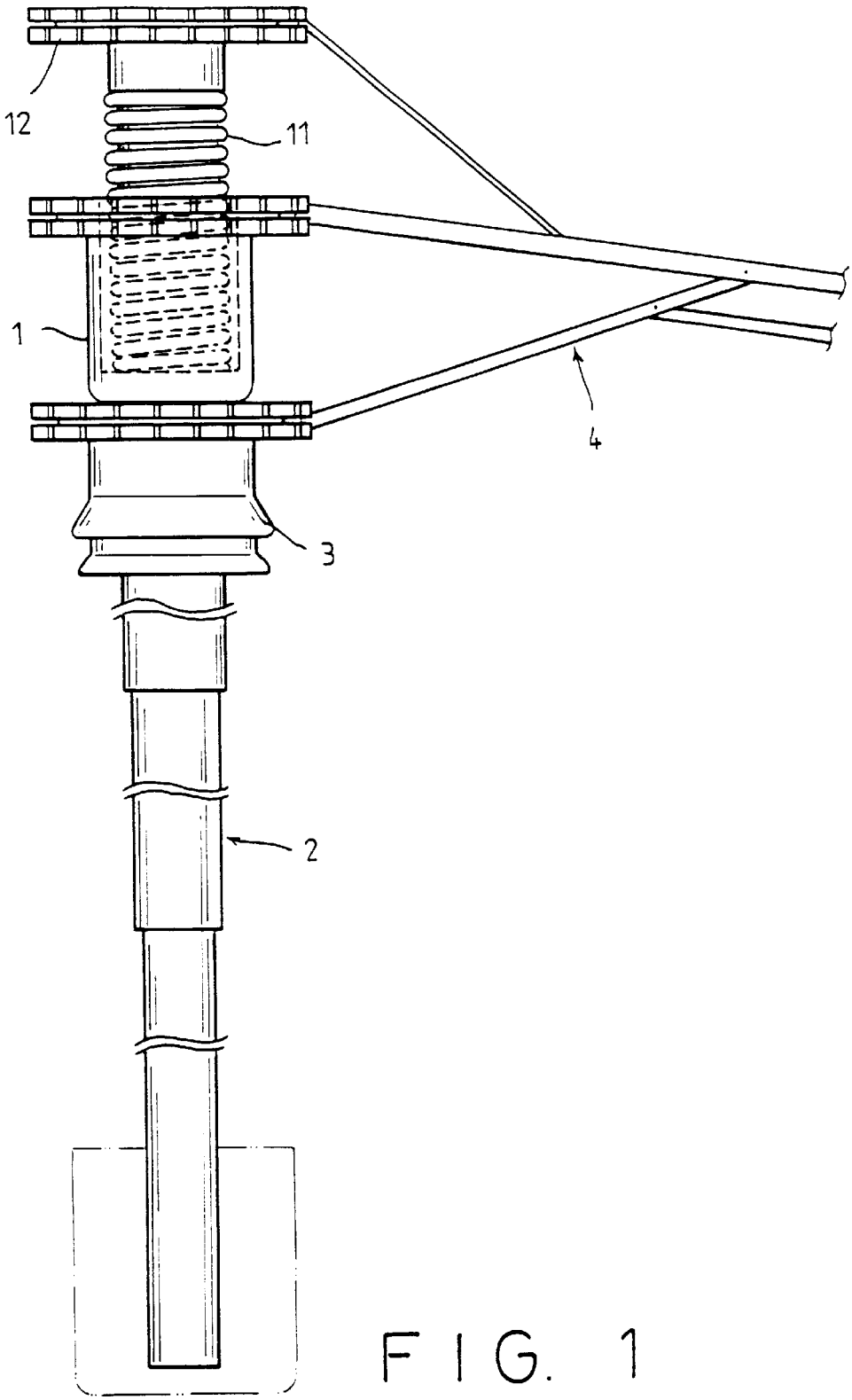
FIG. 1 (prior art)
FIG. 1 is an elevation view of a prior art umbrella in an opened state.
Figure 2:
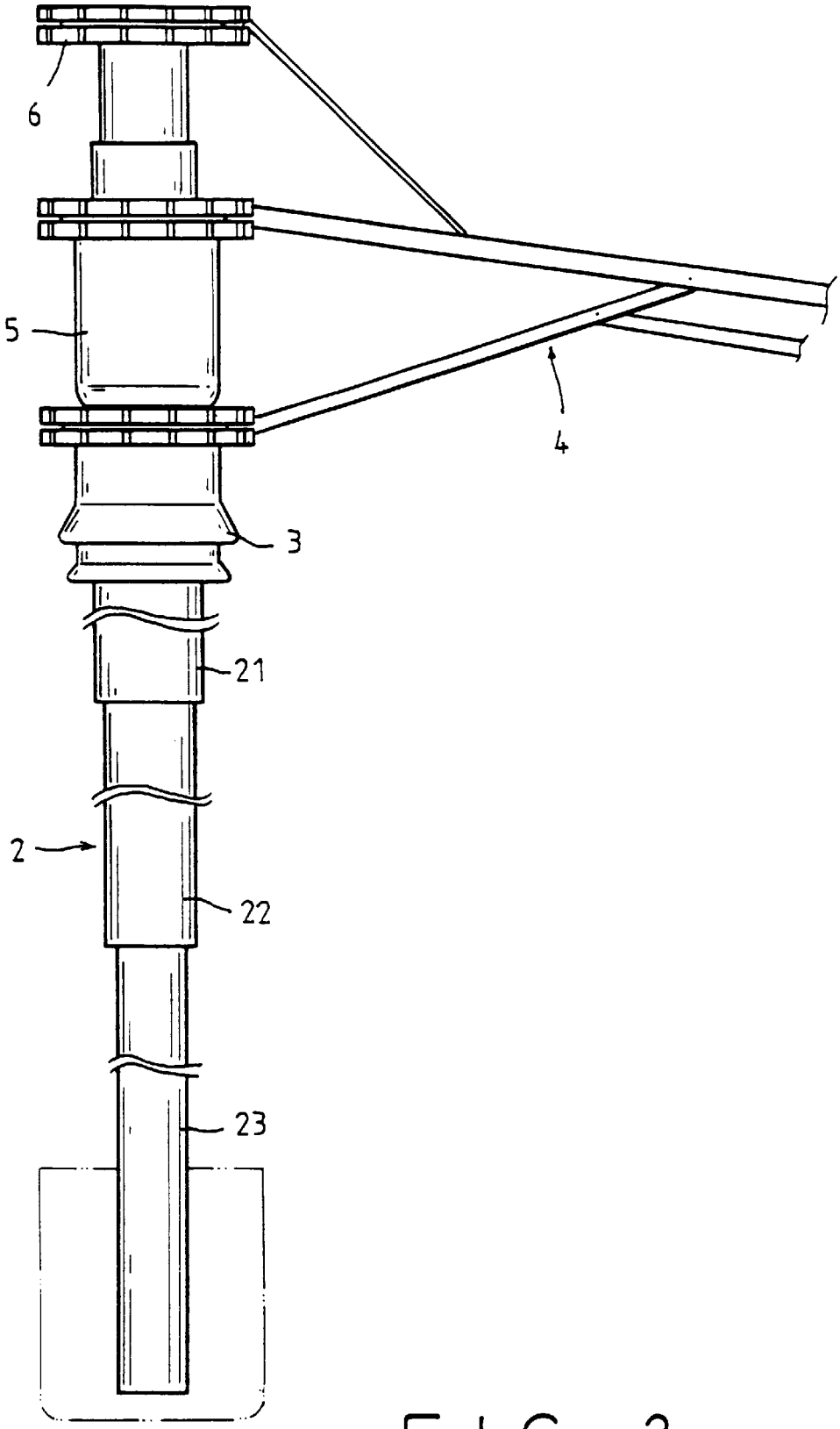
FIG. 2 is an elevation view of a multiple folded umbrella according to the present invention.
Figure 3:
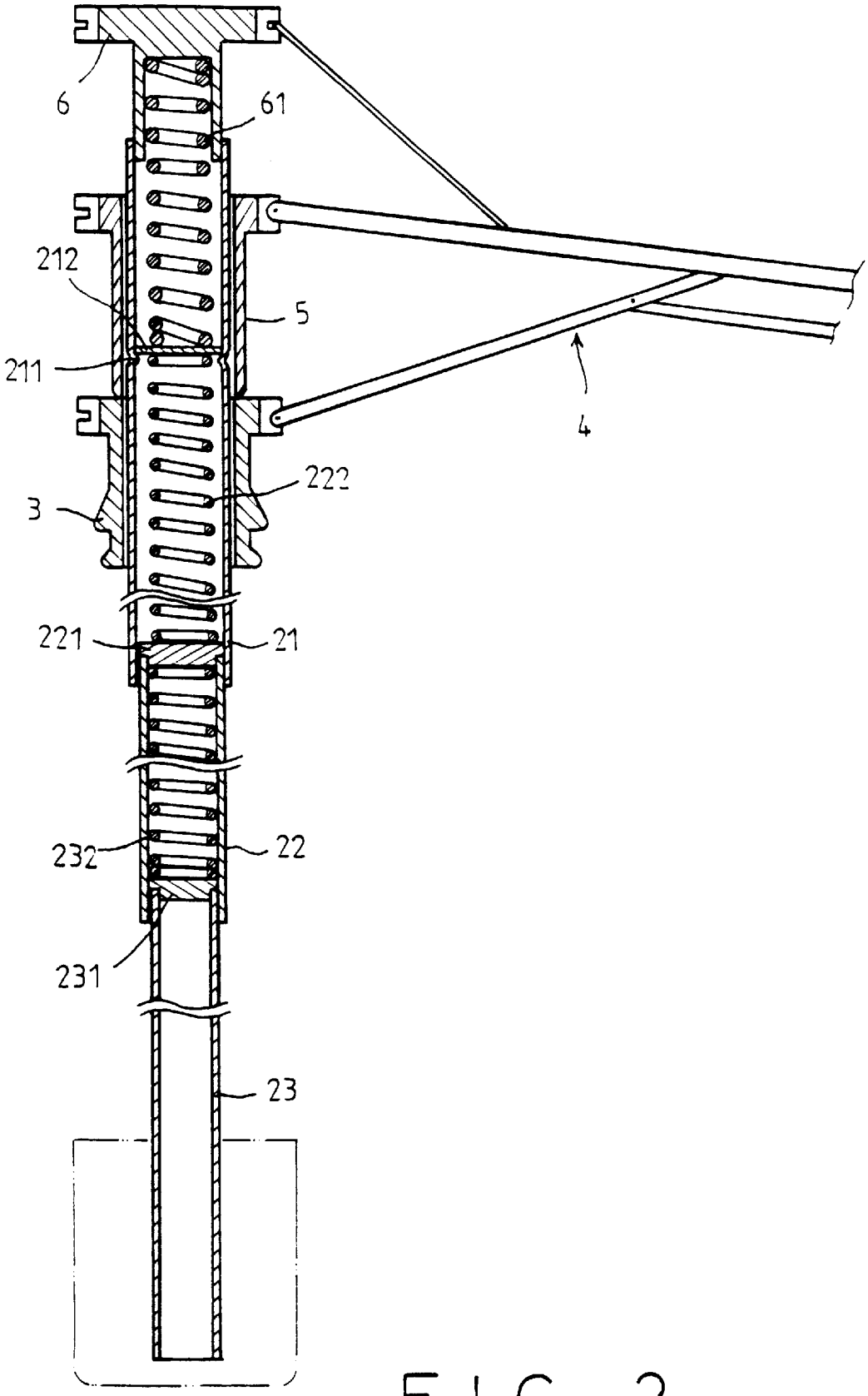
FIG. 3 is a cross-sectional view of FIG. 2.

Referring to FIGS. 2 and 3, the present invention relates to an improvement of a multiple folded umbrella, for example a three-folded umbrella. It can be seen that the umbrella includes a shaft (2) consisting of an upper tube (21), a middle tube (22), and a lower tube (23). A runner (3) is provided around the shaft (2) and an upper connector (5), that is cylindrical, is mounted on a top end of the upper tube (21). A frame having many ribs has its inner ends pivotally connected with the runner (3) and the upper connector (5). The upper tube (21) is provided with an inward flange (211) at a middle position and is provided with a plate (212) on the flange (211). A connecting cap (6) is provided on the top end of the upper tube (21) and has an inner spring (61), which is completely received within the cap (6) and the upper tube (21) and is thereby prevented from becoming rusted. Furthermore, since the spring (61) is placed in the upper tube (21), the upper connector (5) can be designed with a decreased volume and the umbrella can therefore have a smaller closed volume than that of the known prior art. The folded umbrella according to the present invention is then conveniently carried or stored.

Figure 4:
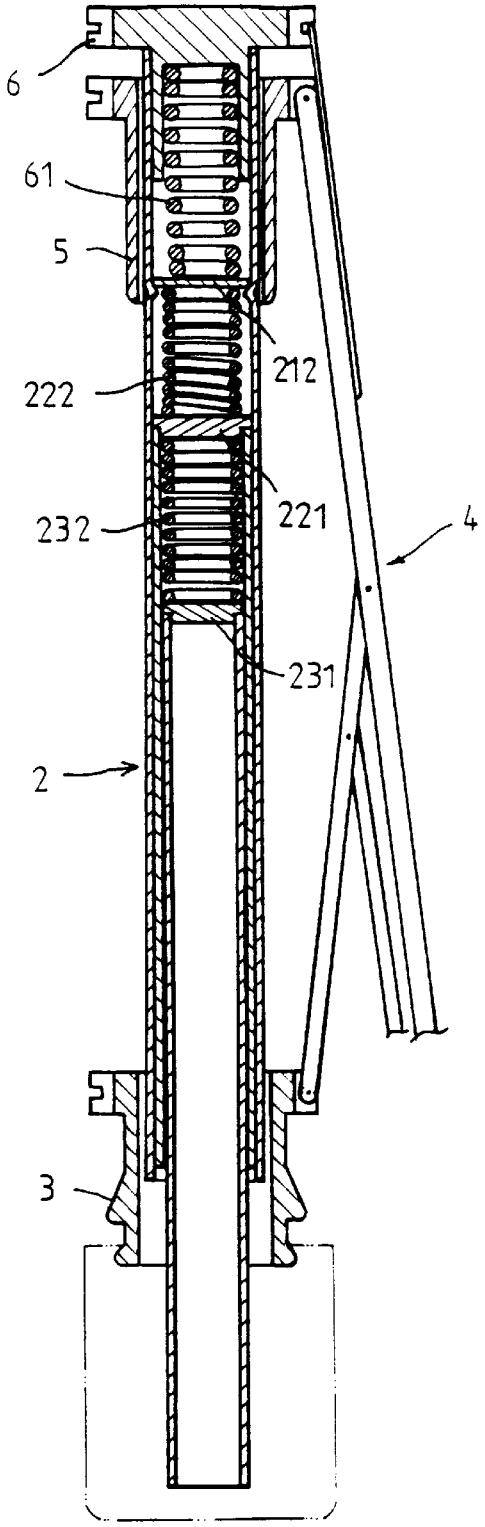
FIG. 4 is an elevation view of FIG. 3 in closed state according to the present invention.

A jointer (221) is engaged on the upper end of the middle tube (22), and another jointer (231) is engaged on the upper end of the lower tube (23). A spring (222) is provided on the jointer (221) and another spring (232) is on the jointer (231). When the umbrella is closed, as in FIG. 4, the springs (61), (222), and (232) are all compressed. As the runner (3) is unlocked, it can be moved upward by the elastic force of the springs and the frame (4) can be extended to complete the opening of the umbrella. The structure is simple, effective, and useful.

Accordingly, it can be found that the present invention obtains an obvious improvement for overcoming the known drawbacks of the prior art. It can be utilized in a multiple folded umbrella, including a two-folded umbrella or a more than three-folded umbrella. The structure avoids exposing the spring to being rusted and has a smaller volume in closed state, and provides a simple, effective use in operation.

I claim:

1. An opening structure of a multiple folded umbrella, comprising:

a tubular shaft, said shaft being formed by an upper tube, a middle tube telescopically coupled to said upper tube, and a lower tube telescopically coupled to said middle tube, said upper tube having an inwardly directed flange formed intermediate opposing upper and lower ends of said upper tube;

a plate member disposed in said upper tube and stopped against said flange to divide said upper tube into respective upper and lower sections;

a connecting cap having a tubular portion telescopically received within said upper end of said upper tube;

a first spring disposed within said upper section of said upper tube between said plate and an inner surface of said tubular portion of said connecting cap for biasing said connecting cap relative to said upper tube;

an upper connector having a tubular body slidingly coupled to said upper tube;

a runner having a tubular body slidingly coupled to said upper tube; and, an umbrella frame pivotally coupled to each said connecting cap, upper connector and said runner.

2. The opening structure as recited in claim 1 further comprising:

a first jointer coupled to an upper end of said middle tube;

a second spring disposed in said lower section of said upper tube between said plate and said first jointer for biasing said middle tube relative to said upper tube;

a second jointer coupled to an upper end of said lower tube; and, a third spring disposed in said middle tube between said first and second jointers for biasing said lower tube relative to said middle tube.

* * * * *